United States Patent [19]

Geinert

[11] Patent Number: 5,054,817

[45] Date of Patent: Oct. 8, 1991

[54] MOVABLE HEADING SYSTEM

[76] Inventor: Anita G. Geinert, 316 E. Laurel Ave., Foley, Ala. 36535

[21] Appl. No.: 557,004

[22] Filed: Jul. 25, 1990

[51] Int. Cl.[5] ..... B42D 11/00

[52] U.S. Cl. ..... 283/66.1; 281/15.1; 40/159

[58] Field of Search ..... 283/66.1, 105; 40/159, 40/405, 641, 661; 281/15.1, 31, 2; 282/1 R

[56] References Cited

U.S. PATENT DOCUMENTS

| | | | |
|---|---|---|---|
| 1,266,142 | 5/1918 | Motsch | 283/66.1 |
| 1,424,968 | 8/1922 | Wherry | 283/66.1 |
| 1,522,542 | 1/1925 | Paine | 283/66.1 |
| 1,865,057 | 6/1932 | Hutchings | 40/641 |
| 2,964,866 | 12/1960 | Chamberlin | 40/159 |
| 3,269,753 | 8/1966 | Rham et al. | 283/66.1 |
| 3,661,407 | 5/1972 | Warren | 283/66.1 |
| 3,943,645 | 3/1976 | Viesturs | 40/159 |
| 4,196,536 | 4/1980 | Westberg | 40/159 |
| 4,468,053 | 8/1984 | Bradley | 40/405 |
| 4,544,360 | 10/1985 | Goodman | 281/15.1 |
| 4,771,557 | 9/1988 | Bowman | 60/159 |
| 4,819,962 | 4/1989 | Takai | 281/15.1 |

FOREIGN PATENT DOCUMENTS

| | | | |
|---|---|---|---|
| 197807 | 7/1978 | United Kingdom | 283/66.1 |

*Primary Examiner*—Frank T. Yost
*Assistant Examiner*—Hwei-Siu Payer
*Attorney, Agent, or Firm*—Richard C. Litman

[57] ABSTRACT

A system of movable headings for bookkeeping includes a cardboard heading strip slidable into transparent plastic envelopes, and the envelopes which are glued to pages of record books. Headings need be written on the heading strip only once. The heading strip then can be moved to another book, or to the next sheet in the same book, for reuse. In a sheaf of pages, the envelope can be moved from a top page to the next page and the page area occupied by the envelope on the previous page removed. A paper cover envelope, open at one end, has carbon paper inside and an adhesive backing; the heading strip is inserted and the headings written on the outside of the envelope. The headings are transferred to the heading strip by the carbon. The paper envelope serves as a record and title of the headings.

9 Claims, 2 Drawing Sheets

MOVABLE HEADING SYSTEM

FIELD OF THE INVENTION

The present invention relates to bookkeeping systems with movable headings.

DESCRIPTION OF THE RELATED ART

Record-keeping books often have preprinted headings on the columns of each page for the convenience of users. The same headings are repeated on each page; when a page is filled, the next page is begun with the same headings.

In the case where the sort of records that are kept are quite usual, for example a ledger, preprinted headings are convenient. Often, however, the need will arise for customized headings on the record columns.

The need for customized headings could arise in many ways. For example, records tracking the tasks of a number of people doing similar work might be required: in recording their work on columnar paper, each column could be assigned to one of the individuals doing the similar work. Or, steps in a customized process could be the column headings.

There is a decided need for customized headings. This is especially true in smaller organizations. A large organization can more easily print customized record books, as its demand for such books will be larger.

Customized record books usually require the repeated writing of individual headings on each separate sheet. This is time-consuming. Also, the chances for error, illegibility, juxtaposition of headings, and so on, are increased as the number of time the headings must be written goes up. Workers are often frustrated by such repetitious tasks as repeatedly filling out the same headings; their frustration can in turn cause more problems. The same idea holds true for sheets, charts, and so on.

The prior art does not disclose any system for easily and reliably repeating headings of record book columns.

Nabon, in U.S. Pat. No. 3,696,532, shows a memo pad consisting of four rectangular sheets of transparent plastic hinged along sides of common length to form a parallelepiped open at the bases. This can be collapsed over a sheet of paper in four ways, which allows headings written on one face of the parallelepiped to be moved to cover different parts of the paper.

Hickman discloses in U.S. Pat. No. 4,810,544 a transparent plastic sheet bisected by a fold for enclosing a paper.

Transparent, flat, rectangular pockets for receiving printed paper, and having adhesive backing for attaching to a surface, are shown in U.S. Pat. No. 3,943,645 of Viesturs and U.S. Pat. No. 4,771,557 of Bowman.

De Rham et al., in U.S. Pat. No. 3,269,753, disclose a system of adhesive-backed pressure-sensitive labels which may be pasted over columns in a record book. The record book is so configured that the columnar pages for record entries are shorter than the cover or base sheet on which the labels are pasted; the cover sheet extends beyond the entry page at the top. The label pasted onto the cover sheet will thus not be covered over when entry pages are turned.

The labels are torn from perforated a sheet and are then hand-printed before pasting onto the cover sheet.

The adhesive is covered with a backing that is peeled off before pasting onto the cover sheet.

The system of de Rham et al. does not disclose reusable headings. The labels cannot be detached and re-adhered to another cover sheet. Also, the system can only be used with a specially-configured record book having differently-sized cover sheets and entry pages. Ordinary record books, whose pages are alike in size, cannot use it.

Warren, in U.S. Pat. No. 3,661,407, shows heading strips having a backing of reusable adhesive. The strips are initially covered on the back by waxed paper and are printed with the desired headings; then the waxed paper is peeled away and the strip adhered to a first columnar page. The strip is then transferred to a second book, and then back to the first book.

Clearly the number of times the heading strip can be reused is limited by the properties of the adhesive backing on the heading strip and by the environment in which the adhesive is used. Generally, a reusable adhesive is not so secure as a permanent adhesive, and a heading strip backed by reusable adhesive may fail, especially upon reuse. Warren notes this possibility and employs double heading strips to avoid it.

SUMMARY OF THE INVENTION

The present invention, a system for bookkeeping with customized headings over columns in a record book, includes a heavy paper or cardboard heading strip (on which headings are written) which is slidable into transparent plastic envelopes shaped to accept the heading strip. The envelopes are glued to the pages of a record book in such a position that, when the heading strip is inserted, the headings written on it will line up with the columns on the pages of the record book.

Headings need be written on the heading strip only once. The heading strip then can be moved to the next sheet in the record book, or to another book.

In a sheaf of pages in a record book, the heading strip can be moved from one page to the next page and the page area occupied by the envelope on the previous page removed. Thus the heading strip can remain visible.

A paper cover header (envelope), open at one end, has carbon paper inside and an adhesive backing; the heading strip is inserted and the headings written on the outside of the envelope. The headings are transferred to the heading strip. There are two paper headers, one for inside the front cover and one for inside the back cover.

Accordingly, one object of the present invention is a bookkeeping system which allows column headings to be transferred from one page of a record book to another page.

Another object of the present invention is a bookkeeping system which allows column headings to be transferred from one record book to another record book.

Yet another object is a bookkeeping system which requires that a heading be written only once to provide headings for a book cover and all pages of the book.

Still another object is a bookkeeping system which prints a cover label at the same time as a heading strip is printed.

A further object is a bookkeeping system that is adaptable either to be fitted to record books at the bindery, or, made in kit form for installing in any existing record book.

With these and other objects in view which will more readily appear as the nature of the invention is better understood, the invention consists in the novel combination and assembly of parts hereinafter more fully described, illustrated and claimed with reference being made the attached drawings.

BRIEF DESCRIPTION OF THE DRAWINGS

Similar reference characters denote corresponding parts throughout the several figures of the drawings.

DESCRIPTION OF THE PREFERRED EMBODIMENT

Figures 1, 2, 3:
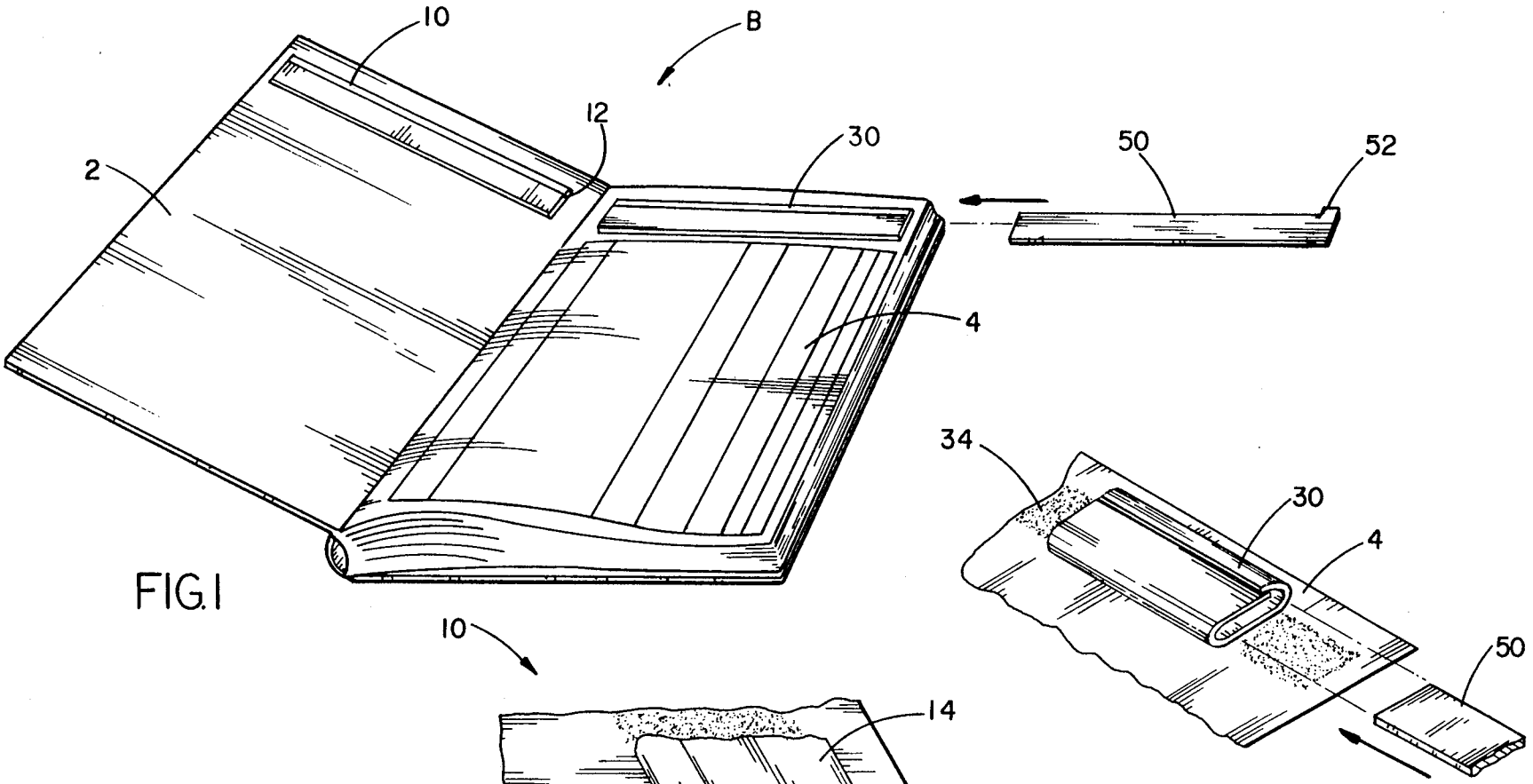
FIG. 1 is a perspective view of a record book showing the cover header on the inside front cover, the transparent envelope on the first columnar page, and the heading strip disposed outside the envelope in which it normally rests.
FIG. 2 is a cross section of the cover header showing the layers of paper, adhesive, and carbon for transferring the headings to the heading strip.
FIG. 3 is a perspective cross section of the transparent envelope.

Referring to FIG. 1, a record book B is shown open to the first page. The inside of the front cover 2 of the record book has a cover header 10 adhesively attached. (The cover header is detailed in FIG. 2., and its function is explained below.) The first page or sheet 4 of the record book has at its top the transparent envelope 30 which is detailed in FIG. 3. The heading strip 50 is shown alongside the envelope. This strip is made of heavy paper or cardboard, and may be colored for ease of reading, for coding of various heading strips, and the like.

After the heading strip 50 has headings suitable to the columns of the page 4 written upon it, it is inserted into the transparent envelope 30. The stop handle or tab 52 stops the insertion and locates the strip relative to the envelope 30, and thereby locates the headings on the strip 50 to the columns of the page 4.

Referring to FIG. 3, the transparent envelope 30 is shown upon the columnar page 4. The envelope is adapted to accept the strip 50 and display the indicia upon it. The envelope is preferably made of a clear plastic such as cellophane. It is fastened to the page 4 by an adhesive 34.

The heading strip remains in the envelope until the columns of the page are filled. Then the strip is moved to another page.

Naturally, envelopes can be mounted on either side of a sheet in a record book.

In some cases, as when the heading strip occupies the middle of a page, it may be advantageous to remove the area of the filled-in sheet or page, so that the heading strip is still visible when the pages of the record book are not opened. In this case, after the strip is removed from a page then the area which the envelope occupied is also removed.

Figure 4:
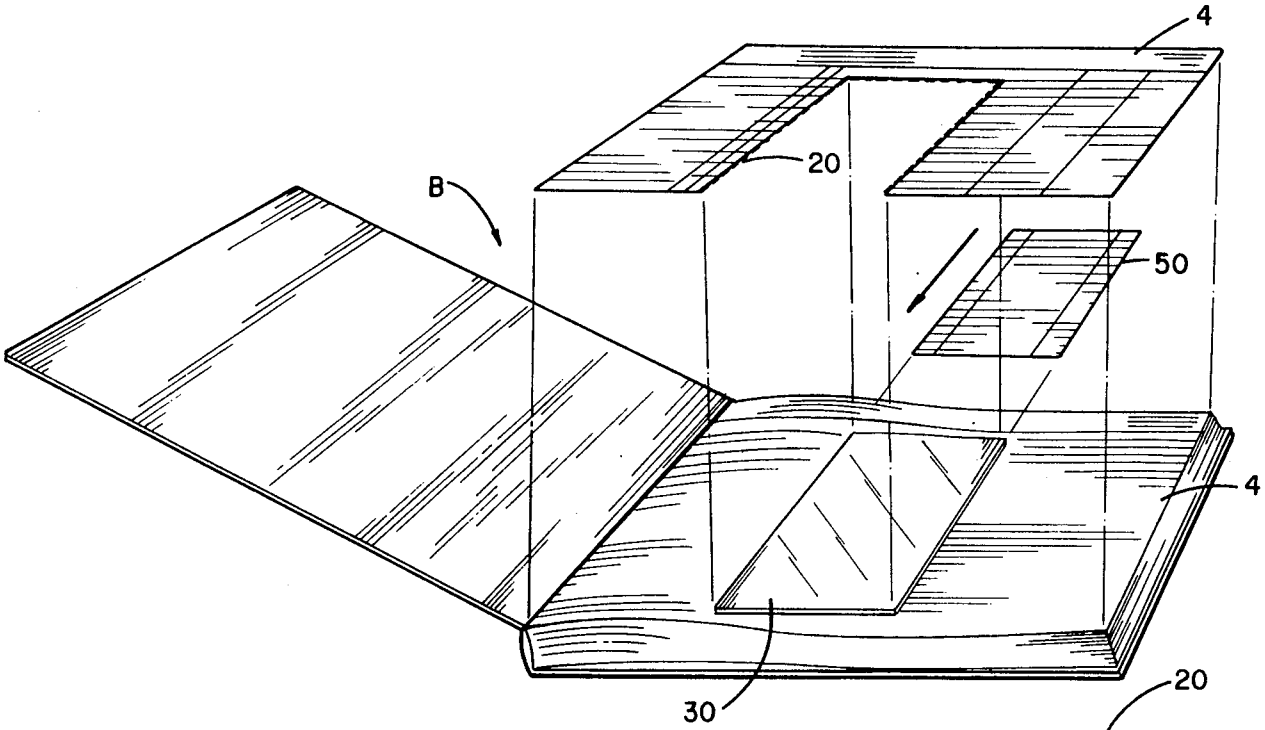
FIG. 4 is a perspective view of the perforated page embodiment in which the envelopes are removable.

FIG. 4 shows a record book having an envelope 30 in the middle of the page 4. The heading strip 50 is shown removed from the envelope. The page 4 has perforations 20 surrounding the envelope 30. A removed page 4 is shown above the page in the book B, with the area inside the perforations removed, as after the page is filled. (In use, entire pages are not removed, only areas inside the perforations 20. The removed page is merely illustrative.)

Figure 5:
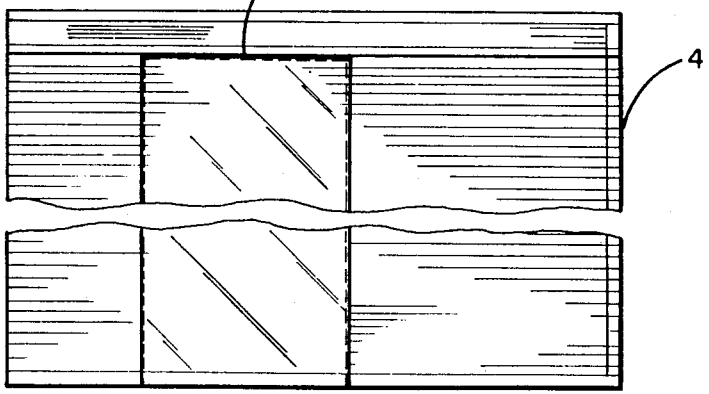
FIG. 5 is a plan view of a page of the book of FIG. 4.

FIG. 5 shows the book page 4 of FIG. 4 in plan view. The columns and perforations 20 are clearly visible.

Ordinarily the heading strip will be blank before customized headings are written onto it. But, preprinted strips are also usable with the system, as are strips with other indicia such as column separation lines, indications of department, notes, etc.

The preferred method of imprinting headings onto the strip is by using the cover header or cover envelope, shown in FIG. 2. In this method, the heading strip 50 is first inserted into the open end 12 of the cover header 10. The proper depth of insertion is automatically set when the tab 52 touches the end 12. Headings are then written onto the top surface 14 of the cover header.

As headings are written, the force of the pen or pencil transfers the writing to the heading strip 50 within (the strip is not shown in FIG. 2) by means of the carbon layer 16. Thus the same headings appear on the cover header and the heading strip.

Clearly, for the cover header 10 to function as is described above, its top surface 14 must be suitable for writing on by ordinary pencils and pens. Therefore, the cover header 10 will normally be made of paper rather than of smooth plastic. Unlike the transparent envelope 30, the cover header 10 does not need to be transparent.

As a result of writing on the outside of the cover header 10, the same image that is written directly onto its top surface 14 will also be impressed onto the surface of the inserted heading strip 50 by the transfer of carbon (or equivalent material) from the layer 16 onto the heading strip 50. The heading strip 50 with its transferred writing can then be removed from the opaque cover header 10 envelope for insertion into a transparent envelope 30, wherein the transferred writing will be visible. The cover header 10 retains the same direct writing on its top surface 14, for independent use of the cover header 10 as a heading (if desired).

Still referring to FIG. 2, the cover header 10 is attached to the cover 2 by a layer of adhesive 18. Preferably, the adhesive is of the reusable type, whereby the cover header can be transferred to another book if need be.

The system optionally includes two cover headers: one for the inside front cover of the record book, and the second for the inside back cover of the record book.

The headings marked on the cover headers are useful if the page of the record book whose envelope contains the heading strip has been removed, as from a looseleaf record book. The cover header can then be used as an auxiliary heading by aligning a separate sheet to it.

The cover headers, after use with the strip, function to identify to users the headings in use in that record book without having to flip pages through to the page with the strip in its envelope.

The invention has two modes of deployment. In the first, the system (consisting of header strips, envelopes, and cover headers) is a kit designed to be used with a commercially available record book. In the other mode the system is built into a record book at the bindery. The two are essentially alike, with the following differences:

In the kit mode, the envelopes have a press-on adhesive (as opposed to a permanent adhesive) on their backs, and each page of the record book receives one envelope. Also, the envelope areas which may be cut away are in the built-in form serrated for easy removal:

in the kit form these areas must be cut out with a scissors or knife.

Note that in this application, "column" means column or row. The heading strip may be used equally well in a horizontal or vertical position; at the edge of a page, or in the center; part-way across a page or fully side-to-side.

In general it is to be understood that the instant invention is not limited to the sole embodiment described above, but encompasses any and all embodiments within the scope of the following claims.

I claim:

1. A movable heading system in combination with a record keeping book, said book including a front cover, a back cover, and sheets bearing column indicia, said heading system comprising:

a generally rectangular heading strip for column headings indicia;

a plurality of transparent rectangular envelopes adapted to internally accept said heading strip, each of said envelopes having two closed sides, and an open end to internally accept said heading strip through said open end; and an adhesive layer disposed over an area of said envelope for fastening said envelopes to said sheets; whereby said heading strip may be inserted into any of said envelopes and headings written upon said heading strip may be visible through each of said envelopes and thereby useful as column headings.

2. The combination of heading system and record keeping book as in claim 1 wherein said heading strip includes a tab extending from the generally rectangular outline of said heading strip, said tab adapted to limit insertion of said heading strip into said envelopes.

3. The combination of heading system and record keeping book as in claim 1, including perforations on each of the sheets, said perforations closely surrounding an area on each of the sheets whereon one of said envelopes is adhesively fastened, whereby said areas may be easily removed to uncover another one of said envelopes in the corresponding area of another sheet.

4. The combination of heading system and record keeping book as in claim 1, including a rectangular cover envelope, for mounting on said cover of said record book, having four sides, a top having an inside surface and an outside surface, and a bottom having an inside surface and an outside surface;

one of said sides open for accepting said heading strip;

said inside surface of said top having disposed thereupon matter adapted to transfer a pattern of writing from said outside surface of said top to said heading strip;

said outside surface of said bottom having disposed thereon adhesive matter; whereby said outside surface of said bottom may be attached to said cover.

5. The combination of heading system and record keeping book as in claim 4 wherein the adhesive matter is adapted to be reused.

6. A movable heading system in combination with a record keeping book, said book including a front cover, a back cover, and sheets bearing column indicia, said heading system comprising:

a generally rectangular heading strip for column headings indicia;

a plurality of transparent rectangular envelopes adapted to internally accept said heading strip, each of said envelopes having two closed sides, and an open end to internally accept said heading strip through said open end; and an adhesive layer disposed over an area of said envelope for fastening said envelopes to said sheets; whereby said heading strip may be inserted into any of said envelopes and headings written upon said heading strip may be visible through each of said envelopes and thereby useful as column headings.

7.The combination of heading system kit and record keeping book as in claim 6, including a rectangular cover envelope, for mounting on the covers of the record keeping book, said cover envelope having four sides, a top having an inside surface and an outside surface, and a bottom having an inside surface and an outside surface;

one of said sides open for accepting said heading strip;

said inside surface of said top having disposed thereupon matter adapted to transfer a pattern of writing from said outside surface of said top to said heading strip;

said outside surface of said bottom having disposed thereon adhesive matter; whereby said outside surface of said bottom may be attached to said cover.

8. The combination of heading system kit and record keeping book as in claim 7 wherein said heading strip includes a tab extending from the generally rectangular outline of said heading strip, said tab adapted to limit insertion of said heading strip into said envelopes.

9. A movable heading system for columnar record keeping sheets, the sheets bearing column indicia, comprising:

a generally rectangular heading strip for column headings indicia;

a plurality of transparent rectangular envelopes adapted to internally accept said heading strip, each of said envelopes having two closed sides, and an open end to internally accept said heading strip through said open end, said envelopes adapted to be each adhesively fastened to one of the sheets; and a tab extending from the generally rectangular outline of said heading strip, said tab adapted to limit insertion of said heading strip into said envelopes; whereby said heading strip may be inserted into any of said envelopes and headings written upon said heading strip may be visible through each of said envelopes and thereby useful as column headings.

* * * * *